United States Patent [19]

Marshik

[11] Patent Number: 4,805,262

[45] Date of Patent: Feb. 21, 1989

[54] SLIDING PANEL ROLLER ASSEMBLY

[75] Inventor: Gary J. Marshik, Canton, S. Dak.

[73] Assignee: JW Window Components, Inc., Tampa, Fla.

[21] Appl. No.: 97,761

[22] Filed: Sep. 17, 1987

[51] Int. Cl.[4] ..... E05D 15/06

[52] U.S. Cl. ..... 16/105; 16/34; 16/91; 49/425

[58] Field of Search ..... 16/102, 103, 105, 34, 16/91; 49/425

[56] References Cited

U.S. PATENT DOCUMENTS

| | | | |
|---|---|---|---|
| 3,283,444 | 11/1966 | Andres | 49/420 |
| 3,299,575 | 1/1967 | DuShane | 49/420 |
| 3,386,208 | 6/1968 | Banner | 16/105 |
| 3,443,340 | 5/1969 | Helmick et al. | 49/420 |
| 3,613,313 | 10/1971 | Helmick | 49/420 |
| 3,716,890 | 3/1973 | Benson | 16/91 |
| 3,722,028 | 3/1973 | Schoenbrod | 16/91 |
| 4,112,622 | 9/1978 | Stewart | 16/91 |
| 4,353,186 | 10/1982 | Offerdinger | 16/105 |

*Primary Examiner*—Fred Silverberg
*Assistant Examiner*—Edward A. Brown
*Attorney, Agent, or Firm*—James W. Grace; Charles W. Vanecek

[57] ABSTRACT

The roller assembly of this invention comprises a grooved wheel attached to a perforated metal tape or spring which is movable over a sloping track by means of a toothed gear wheel or sprocket.

11 Claims, 1 Drawing Sheet

SLIDING PANEL ROLLER ASSEMBLY

BACKGROUND OF THE INVENTION

1. Field of the Invention

This invention relates to closures which comprise horizontally sliding, closing panels such as patio screen doors which move on grooved rollers on a guide track. More particularly, this invention relates to a novel roller assembly for such doors and the improved doors themselves.

2. Description of the Prior Art

In the prior art there are numerous types of roller assemblies for patio screen doors. In some types, the roller has been made as part of a corner connector which holds adjacent frame members together at a common bevel line. In these types, there is generally an elongated screw member which must be turned to release a spring loaded roller assembly into operating connection with a track. Other types of roller assemblies use vertically located screws to release spring loaded roller assemblies into such operating engagement. These arrangements have the disadvantage attendant upon any spring loaded mechanism which is the maintenance of proper spring tension over an extended period of time.

Some of the roller assemblies which rely upon a set screw to release the roller which can be operated only from the inside of the patio screen door. At times this becomes inconvenient. It is preferable to have a roller release mechanism which is accessible from either the inside or the outside of the patio screen door.

In addition, the assembly of such spring loaded assemblies can be time consuming and require skilled workmen for assembly or repair.

SUMMARY OF THE INVENTION

The present invention relates to a roller assembly for patio screen doors which comprises a minimum of moving parts for easy assembly and which does not necessarily rely on spring tension for operation and which can easily be repaired.

The roller assembly of this invention comprises a grooved wheel attached to a perforated metal tape or spring which is movable over a sloping track by means of a toothed gear wheel or sprocket. In addition, the grooved wheel can be maintained within the frame of the patio screen door during shipment and released upon installation.

It is, therefore, an object of the present invention to provide a novel roller assembly for a movable closure.

It is another object of the present invention to provide a novel roller assembly for a movable closure which is easy to assemble and simple to operate.

It is yet another object of the present invention to provide a novel roller assembly for a movable closure which can be adjusted from either side of the closure.

It is a further object of the invention to provide a novel roller assembly in which the wheel assembly can be easily replaced if the wheel breaks.

Figure 2:
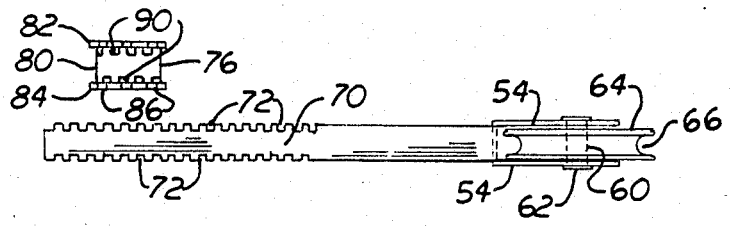
Figure 1:
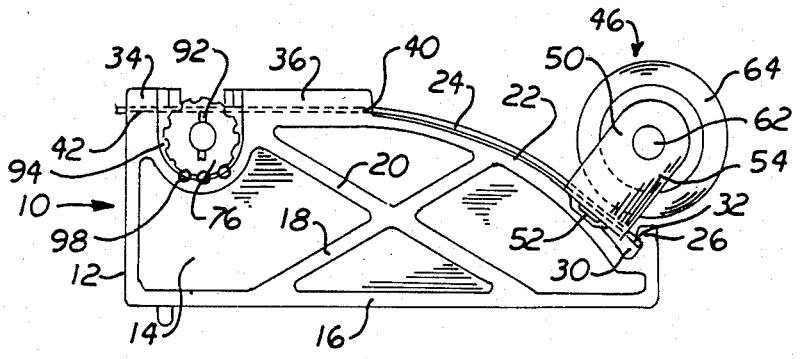
Figure 3:
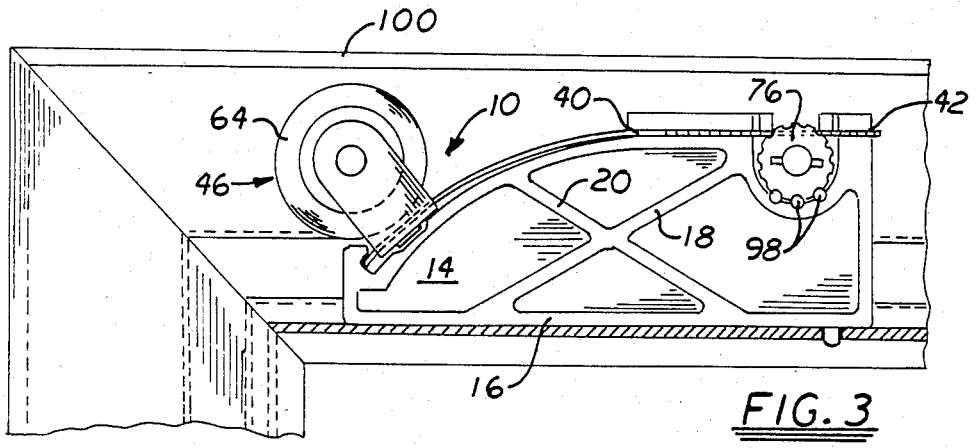
Figure 4:
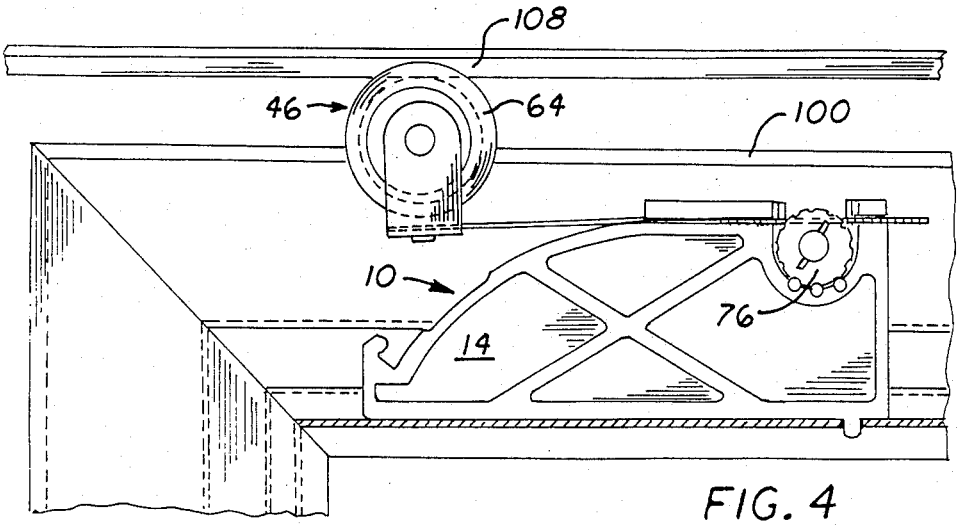

These and other objects of the present invention will become apparent to those skilled in the art when the following description is considered in conjunction with the accompanying drawing in which like numerals indicate like elements and in which:

FIG. 1 is a side elevational view of the roller assembly of the present invention, FIG. 2 is a top view of the roller leaf spring and toothed gear wheel assembly of the present invention in separated arrangement, FIG. 3 is a side elevational view of a portion of a frame of a patio door with the roller assembly in condition for shipment, and FIG. 4 is a side elevational view of a portion of a frame of a patio door with the roller assembly in position for operation on a track.

With reference to FIG. 1, there is shown the roller assembly 10 of the present invention which comprises a block 12. Block 12 may be made of metal such as aluminum, copper or steel but preferably is made of plastic such as polypropylene. Plastic is preferred because it is relatively cheap and can easily be molded into the proper shape.

Block 12 has a relatively thin central area 14 which has a thicker perimeter 16 extending completely around the outer edge of central area 14. Strengthening crossed ribs 18 and 20 are molded as part of the central area 14 of block 12 to further strengthen block 12. Corresponding ribs (not shown) are molded on the opposite side of block 12. Block 12 is generally of rectangular shape but has a portion of its upper face 22 formed in the shape of an arc sloping downwardly to the right, in the version shown in the drawing. This smooth-curved face 22 forms a track over which a flat, leaf spring 24 can ride. At the lower right end of curved face 22 is a short, upright extension 26 rising from and integral with the bottom right hand end of block 12. A shallow notch or groove 30 is cut into extension 26 to receive the end 32 of spring 24.

Block 12 has two plates 34 and 36 which are integrally molded along one side of the upper face of block 12. Plates 34 and 36 are separated from the upper face of block 12 by narrow slits 40 and 42. Slits 40 and 42 provide guide means for a portion of leaf spring 24.

Leaf spring 24 in one condition lies along the upper face 22 of block 12 and extends from slots 40 and 42 of plates 34 and 36 to notch 30. Leaf spring 24 is a thin, steel strip having a width slightly less than the width of the perimeter 16 of block 12.

Attached near one end of leaf spring 24 is a wheel assembly 46. Wheel assembly 46 comprises a U-shaped strip 50 of thin metal such as aluminum. Strip 50 is bent in the form of a U with its center or bight at the bottom and the extending wings 54 (only one of which is shown) have a small hole 60 drilled therethrough near their outer edges. A pin or axle 62 lies in and between the wings 54 of strip 50 to form an axle for a grooved wheel 64. Wheel 64 is made of plastic, such as polypropylene, and has grooves 66 (FIG. 3) which ride on a guide track (shown in FIG. 4) when the patio door or closure is set in place. Wheel assembly 46 is fixed to leaf spring 24 by a rivet 52 located at the bight of U-shaped strip 50.

As shown in FIG. 3, an area 70 near the end of leaf spring 24 opposite wheel assembly 46 has alternate cut-outs or notches 72 on each side of leaf spring 24. The cut-outs 72 are formed by cutting out small areas on each side of leaf spring 24 to form a means by which leaf spring 24 can be moved reciprocally from right to left and vice versa by means of a toothed gear wheel 76. This mechanism is similar to that of the sprocket mechanism in a film projector.

Toothed gear wheel 76 is in the form of a spool or sprocket having a central cylindrical core 80 and two outer rims, 82 and 84 integral with core 80 but of greater diameter. The length of cylindrical core 80 between rims 82 and 84 is equal to the width of leaf spring 24. Around the perimeters of rims 82 and 84 are located a series of projections 86 which serve to lock the gear wheel 76 in a preselected position. Around the perimeter of cylindrical core 80 and at the junction of core 80 and each of the rims 82 and 84 are a series of projections 90 which are adapted to engage notches 72 of leaf spring 24. On each side of toothed wheel 76 is a slot 92 designed to receive the end of a flat-edged screwdriver (not shown) which is used to rotate toothed wheel 76 in a clockwise or counterclockwise direction.

In the upper face 22 and near the left edge of block 12 is a U-shaped hole 94 ringed by the thicker perimeter 16 of central area 14. U-shaped hole 94 is designed to receive toothed wheel 76 and a narrow semicircular raised portion of central area 14 act as a guide in which toothed wheel 76 can be rotated. Along the lower outer edges of hole 94 are a series of protrusions 98 which receive projections 86 of toothed wheel 76 to keep wheel 76 from freely rotating.

In assembly, after U-shaped strip 50 and grooved wheel 64 have been assembled to form wheel assembly 46 and have been fixed to leaf spring 24 by a rivet or fastener 52, toothed gear wheel 76 is placed into U-shaped hole 94. The left end of leaf spring 24 is inserted into slot 40 at its right-hand opening and leaf spring 24 is pushed toward gear wheel 76 until the notches 72 of leaf spring 24 engage some of the projections 90 of gear wheel 76. The blade of a screw driver (not shown) is inserted into hole 94 and gear wheel 76 is rotated counterclockwise to pull leaf spring 24 into engagement with slots 40 and 42 and then the left end of leaf spring 24 may extend beyond the left edge of block 12. As the leaf spring 24 enters slot 42, it forces gear wheel 76 downwardly so that projections 86 of gear wheel 76 engage protrusions 98 around the lower outer edge of hole 94. While the turning force of the screwdriver can rotate gear wheel 76, gear wheel 76 is not free to move otherwise and is locked in place against further free rotation.

If it is desired to lock the wheel assembly 46 in the position shown in FIGS. 1 and 3, which is the position for shipment of the patio door, it is only necessary to depress the wheel assembly against the downwardly sloping surface 22 of block 12 and to turn the screwdriver in a clockwise direction so that leaf spring 24 moves to the right. When the end 32 of leaf spring 24 enters groove 30 of block 12, the wheel assembly will be in its proper position for shipment.

When it is desired to release the end 32 of leaf spring 24 from its engagement with groove 30, gear wheel 76 is rotated in a counterclockwise direction and leaf spring 24 moves to the left to release end 32 of leaf spring 24 from groove 30. The tension in leaf spring 24 tends to straighten it and wheel 64 moves upwardly to a position above and outwardly of plates 34 and 36 and the upper edge of the frame (See FIG. 4).

As may be seen in FIG. 3, roller assembly 10 is inserted in a frame section 100 which forms a part of the outer frame of a patio screen door. The remaining parts of the screen door are not shown as they are entirely conventional. Roller assembly 10 may be secured in place by glue or other adhesive to prevent its movement within the frame 100 or by any conventional locking mechanism, such as, projections on roller assembly 10 which engage corresponding grooves or slots in frame 100. In the view shown in FIG. 1 and FIGS. 3, roller assembly 10 is placed in the upper frame of the patio door. Access holes (not shown) (one on each side of the frame 100) are cut into frame 100 in alignment with the slotted face of gear wheel 76 to permit a screwdriver to reach slot 94 in gear wheel 76.

FIG. 3 illustrates the condition where roller assembly 10 is in its locked position for shipment of the patio screen door. In this position, wheel 64 is maintained below the upper edge of the top frame 100 of the patio door. It should be understood that roller assembly 10 can be placed in the lower frame member of a patio screen door and its position will be revised with respect to that shown in FIG. 3. Also, it should be understood that the roller assembly shown in FIG. 1 can be placed in either a right-hand or left-hand position in the frame of the patio door depending upon whether the upper or lower frame of the door receives the roller assembly and whether the roller assembly is at the right-hand or left-hand end of the patio door.

FIG. 4 shows the roller assembly 10 of the present invention in the condition where wheel assembly 46 is released from its locked position. This is accomplished by rotating gear wheel or sprocket 76 in a direction to release end 32 of leaf spring 24 from groove 30 of block 12. In this case, the spring tension of leaf spring 24 causes wheel 46 to extend beyond the upper edge of frame 100 and wheel 46 can engage track 108.

One advantage of the present invention is that, if the spring tension of leaf spring 24 loses its force because of age, it is merely required to rotate gear wheel 76 to move leaf spring 24 and wheel 46 further along the rising face 22 of block 12.

It is easily seen that in the event grooved wheel 46 which is made of plastic breaks, it is a simple matter to replace the wheel and spring assembly by merely rotating gear wheel 76 to disengage leaf spring 24 and replace the broken wheel and spring assembly with a new wheel and spring assembly by inserting an end of new leaf spring 24 into engagement with projections 90 of gear wheel 76.

While specific embodiments of the present invention have been shown and described, it is contemplated that other modifications and changes may occur to those skilled in the art and such modifications and changes are included within the scope of the appended claims.

I claim:

1. A roller assembly adapted to be mounted in the frame of a sliding panel comprising a central block having an upper face, said upper face of said block comprising a horizontal portion and a sloping portion connected to said horizontal portion, said sloping portion extending downwardly in a direction away from said horizontal portion, said block further having at least one horizontal slot cut in said horizontal portion below the upper surface of said face, said block having a transverse opening adapted to receive a sprocket wheel, a sprocket wheel mounted for rotation in said transverse opening, and a wheel assembly comprising a wheel having a grooved periphery, said wheel assembly being mounted on a flat spring, and a portion of said flat spring being received in said horizontal slot in said horizontal portion of said block and directly engaging said sprocket wheel.

2. A roller assembly adapted to be mounted in the frame of a sliding panel, as recited in claim 1, in which said sloping portion of said upper face is in the shape of an arc.

3. A roller assembly adapted to be mounted in the frame of a sliding panel, as recited in claim 1, in which said upper face has a shallow notch formed at the lowermost end of said downwardly sloping portion, said notch being adapted to receive the end of said flat spring opposite said portion of said flat spring which is received in said horizontal slot.

4. A roller assembly adapted to be mounted in the frame of a sliding panel, as recited in claim 1, in which said block comprises a central section and a peripheral area surrounding said central section, said peripheral area being wider than said central section.

5. A roller assembly adapted to be mounted in the frame of a sliding panel, as recited in claim 3, in which said block has integrally molded, strengthening cross-ribs.

6. A roller assembly adapted to be mounted in the frame of a sliding panel, as recited in claim 1, in which said sprocket wheel has a central, cylindrical core and a pair of rims integrally mounted to said central core, said rims having projections extending outwardly therefrom, said transverse opening having a series of protrusions around the outer edges thereof, said protrusions around said outer edges of said transverse opening being adapted to engage said protrusions of said rims to lock said sprocket wheel in a preselected position.

7. A roller assembly adapted to be mounted in the frame of a sliding panel, as recited in claim 1 in which said sprocket wheel has a central, cylindrical core and a pair of rims integrally mounted to said central core with individual rims being mounted on opposite sides of said core, said core having projections located around said core adjacent to said rims, said projections being adapted to receive notches in said flat spring.

8. A roller assembly adapted to be mounted in a frame of a sliding panel, as recited in claim 7, in which said spring has a series of notches cut into and along opposite sides thereof, said notches being adapted to engage said projections of said sprocket wheel.

9. A roller assembly adapted to be mounted in a frame of a sliding panel, as recited in claim 1, in which said sprocket wheel has slits cut into each side thereof, said slits being adapted to receive an operating part of a tool for rotation of said sprocket wheel.

10. A roller assembly adapted to be mounted in a frame of a sliding panel, as recited in claim 3, in which one end of said flat spring engages said shallow notch.

11. A roller assembly adapted to be mounted in a frame of a sliding panel, as recited in claim 10, in which said one end of said flat spring is located at the end of said spring opposite said portion of said flat spring which is received in said horizontal slot.

* * * * *